252-99 AU 166 EX

5/30/78 OR 4,092,258

United States Patent [19]

McLaughlin et al.

[11] 4,092,258

[45] May 30, 1978

[54] POWDER DETERGENT COMPOSITIONS

[75] Inventors: Robert L. McLaughlin, Wilmette; Donald C. Wood, Des Plaines, both of Ill.

[73] Assignee: DeSoto, Inc., Des Plaines, Ill.

[21] Appl. No.: 599,487

[22] Filed: Aug. 21, 1975

[51] Int. Cl.[2] ..... C11D 3/04; C11D 7/56

[52] U.S. Cl. ..... 252/99; 252/135; 252/523; 252/DIG. 1

[58] Field of Search ..... 252/99, 135, 541, 523, 252/DIG. 1, 525, 527, 546

[56] References Cited

U.S. PATENT DOCUMENTS

| | | | |
|---|---|---|---|
| 3,048,548 | 8/1962 | Martin et al. | 252/135 |
| 3,248,335 | 4/1966 | Teot et al. | 252/558 X |
| 3,549,539 | 12/1970 | Mallows | 25/99 |
| 3,696,041 | 10/1972 | Gray | 252/99 |
| 3,817,869 | 6/1974 | Ries et al. | 252/99 |
| 3,825,498 | 7/1974 | Altenschopfer | 252/99 |
| 3,826,748 | 7/1974 | Finck | 252/95 |
| 3,880,778 | 4/1975 | House | 252/99 |
| 3,941,710 | 3/1976 | Gilbert | 252/99 |

*Primary Examiner*—George F. Lesmes
*Assistant Examiner*—Edith R. Buffalow
*Attorney, Agent, or Firm*—Dressler, Goldsmith, Clement, Gordon & Shore, Ltd.

[57] ABSTRACT

Powder detergent compositions for machine dish washing which are effective in hard water in the absence of phosphates are provided based on a combination of low foaming nonionic surfactant, bleaching agent, and from 8–70% of ammonium sulfate, ammonium borate, ammonium carbonate, ammonium bicarbonate, or a mixture thereof. The composition is required to provide a pH in the range of pH 7.0 to pH 8.5 measured in 1% water solution.

20 Claims, No Drawings

POWDER DETERGENT COMPOSITIONS

The present invention relates to powder detergent compositions adapted for machine dish washing and which are effective in hard water. These compositions are significant in that they perform in the absence of phosphates.

Detergent compositions in powder form and which are adapted for machine dish washing are usually based on the presence of a large proportion of a phosphate component and frequently possess considerble alkalinity providing a pH above 8.5. This invention is concerned with providing a powder detergent composition which exhibits a pH not in excess of pH 8.5 and which does not require the presence of any phosphate component or any sequestering agent, but which is nonetheless capable of removing foods and leaving the dishes and glasses unspotted while being safe for the dishes which are washed.

In accordance with this invention, a powder detergent composition which does not require the presence of phosphates or sequestering agents and which is effective at a pH in the range of pH 7.0 to pH 8.5 (measured in 1% water solution) consists essentially of the following components by weight:

1- from 2–8% of low foaming nonionic surfactant useful for machine dish washing, 2- from 0.5–5% of available chlorine or oxygen from a bleaching agent, 3- from 8–70% of ammonium sulfate, ammonium borate, ammonium carbonate, ammonium bicarbonate, or a mixture thereof, 4- from 0–50% of borax (the greater the proportion of borax, the smaller the amount of ammonium sulfate or ammonium borate, and 5- any balance of said detergent consisting essentially of inert particulate filler which does not precipitate calcium or magnesium salts at use concentration and buffering agents as needed to provide the desired pH.

The heart of the low pH nonionic surfactant system is the selection therein of ammonium sulfate or ammonium borate, and this permits the invention, in the absence of phosphates, to provide an effective cleaning action without precipitating calcium or magnesium salts when hard water is encountered.

In the presence of borax, as little as 8% of the ammonium compound is effective, but usually at least 10% is required and then the borax may be omitted. When a large amount of borax is present, then extraneous buffers are required to maintain the desired low pH, these buffers being illustrated by sodium bisulfate. When ammonium carbonate or bicarbonate is used, extraneous buffers are also necessary.

The proportion of the ammonium compound may thus vary from 8% to 70%. However, in the absence of the optional borax at least 10% of the ammonium compound is needed, preferably from 25% to 50%, and when large amounts of borax are used, in excess of 10% thereof, then more than 40% of the ammonium compound is not desirable.

It follows that the ammonium compounds can be supplemented by the use of borax and, as more borax is used, less ammonium compound is needed. The addition of borax is preferred in some instances since it is less costly than the ammonium compounds, and this permits the formulation of lower cost detergents while maintaining performance. However, in other instances, a boron-free composition is desired, and this can be provided by this invention. When more than 15% of borax is present, the borax can dominate the cleaning power of the system as pointed out in our previously filed application Ser. No. 583,908, filed June 5, 1975. However, the ammonium compounds are still needed if the pH falls below 7.8.

As a result, an effective powder detergent composition adapted for machine dish washing is provided which is capable of performing in hard water, and in the absence of phosphates. In the preferred compositions, sequestrants are also omitted, and this is also significant because sequestrants add considerably to the expense of the composition. However, small amounts of a sequestrant, such as ethylene diamine tetraacetic acid which has an affinity for iron, may be present in an amount up to about 1% to avoid iron staining in those communities where significant amounts of iron are present in the water supply.

Insofar as we are aware, none of the commercially available dish washing detergents now in use in the United States possess a pH below about 9.2. Current thinking is that a high pH and a high alkalinity are desirable for effective dish washing. A crucial finding in this invention is that this general perspective of the art is not correct in certain limited areas. In this invention, contra to the concepts of the prior art, filming and spotting are avoided in a nonionic system buffered for a pH in 1% water solution in the narrow range of pH 7.0 – pH 8.5.

In contrast with the knowledge of the art, when the compositions of this invention possess a pH above 8.5, then the calcium and magnesium salts in the water are precipitated and water spotting is encountered. The same difficulty arises if silicates are incorporated, and this despite the fact that the presence of silicates is usually required to avoid damaging the dishes or the machine parts. Here, silicate addition raises the pH and causes the compositions of this invention to be ineffective.

While the upper limit of pH is critical as noted hereinbefore, the lower limit of pH is also important since, below pH 7.0, cleaning efficiency falls off.

Referring more particularly to the low foaming nonionic surfactants adapted for machine dish washing, these constitute a recognized class of materials, and while specific types of nonionic surfactants and blends thereof are preferred, the entire class is useful. The nonionic surfactant may be liquid or solid, the former being preferred. These liquid products are easily absorbed on the remaining components of the composition which are primarily solids, and do not interfere with the desired dry powder characteristic because the proportion of surfactant is small.

Ethylene oxide adducts of hydrophobic organic compounds, containing from about 3 to about 30 mols of adducted ethylene oxide per mol of hydrophobic organic compound, constitute the preferred nonionic surface active agent. The hydrophobic organic compound is subject to variation in known fashion, but it usually has a hydrocarbon portion with at least 8 carbon atoms and a single reactive group, either SH or more usually OH. Polyoxypropylene can also provide a hydrophobic base, but it carries two OH groups.

As examples of nonionic surface active agents which may be used and which are formed by reacting about 3 to about 30 mols of ethylene oxide with 1 mol of hydrophobic organic compound, there may be noted the adducts of alkyl phenols with ethylene oxide, e.g., isooctyl phenol or nonyl phenol; the adducts of the corresponding alkyl thiophenols with ethylene oxide; the ethylene oxide adducts with higher fatty alcohols of monoesters of hexahydric alcohols and inner ethers thereof such as sorbitan monolaurate, sorbitol monooleate and mannitan monopalmitate, and the adducts of polypropylene glycols with ethylene oxide. Solid surfactants in this category are illustrated by polyoxypropylene glycol of molecular weight 1700 adducted with ethylene oxide to provide a flake product containing 80% reacted ethylene oxide to provide a molecular weight of 7500.

Further suitable nonionic surfactants are polyoxyethylene esters of organic acids, such as the higher fatty acids, resin acids, tall oil, or acids from the oxidation of petroleum, and the like. The polyglycol esters will usually contain from about 3 to about 30 moles of ethylene oxide or its equivalent and 8 to 22 carbon atoms in the acyl group of the fatty acid. Suitable products are refined tall oil condensed with 16 or 20 ethylene oxide groups, or similar polyglycol esters of lauric, stearic, oleic and like acids.

Additional suitable nonionic surfactants are the polyethylene oxide condensates with higher fatty acid amides, such as the higher fatty acid primary amides and higher fatty acid mono- and diethanol-amides. Suitable agents are coconut fatty acid amide condensed with about 10 to about 30 mols of ethylene oxide. The fatty group will contain 8 to 22 carbon atoms, usually 10 to 18 carbon atoms. The corresponding sulphonamides may also be used.

Particularly suitable polyether nonionic surfactants are the polyethylene oxide ethers of higher aliphatic alcohols. Suitable alcohols are those having from 8 to 22 carbon atoms in the molecule, preferably from 10 to 18 carbon atoms. Examples thereof are iso-octyl, nonyl, decyl, dodecyl, tridecyl, tetradecyl, hexadecyl, octadecyl and oleyl alcohols which may be condensed with from 3–30 mols, preferably from 3–6 mols, of ethylene oxide. Commercial products of this type are illustrated by BASF Wyandotte products Plurafac RA-43 and RA-435. The corresponding alkyl mercaptans or thioalcohols condensed with ethylene oxide are also suitable for use in compositions of the present invention.

As previously indicated, the nonionic surfactant is used in an amount of from 2–8% of the powder composition, preferably 3–6%.

It is particularly preferred to employ as the nonionic surfactant straight $C_8 - C_{18}$ primary alcohols which have been adducted with from 3–6 mols of ethylene oxide per mol of alcohol. This type of nonionic surfactant is particularly desirable in combination with liquid nonionic surfactants in which ethylene oxide is adducted onto a poly(oxypropylene) base, termed a hydrophobe, and having a molecular weight in the range of about 900 to about 4000. The ethylene oxide adduction is carried out to provide from about 5 to about 55% of poly(oxyethylene). These liquid products are commonly known as Pluronic polyols, and the preferred products have a hydrophobe molecular weight of from 2100 to 3600 and contain from 5–45% of poly(oxyethylene). BASF Wyandotte products Pluronic L81, L92, and L101 are preferred, but the other liquid Pluronic polyols are also useful, ranging from L31 and L35 to L121 and L122.

When these two types of nonionic surfactants are used in combination, they may be used in a weight ratio of from 1:5 to 5:1, but are preferably used in a weight ratio of 1:2 to 2:1.

The chlorine or oxygen-supplying bleaching agent is entirely conventional, it being customary to employ such agents in dish washing compositions. The chlorine bleaching agents are more usual, these being illustrated by chlorinated trisodium phosphate, trichlorocyanuric acid, the sodium or potassium salt of dichlorocyanuric acid, and dichlorodimethylhydantoin. Inorganic hypochlorites such as lithium, potassium, and magnesium hypochlorites are also useful. The oxygen-supplying bleaching agents which may be used are also conventional, such as alkali metal persulfates, percarbonates, perborates, and the like, typically illustrated by sodium perborate.

The term "borax" is intended to identify alkali metal (primarily sodium) borate hydrates, typically the decahydrate. These borates have the formula $Na_2B_4O_7.xH_2O$, and when proportions are given herein for borax, it will be understood that while one is not restricted to the decahydrate, it is the decahydrate which is normally used, and it is the decahydrate which is used as the basis for calculation.

When borax is present, it elevates the pH of the system, but this can be countered using buffering agents, such as sodium bisulfate or citric acid.

The inert particulate filler is subject to wide variation, sodium sulfate and potassium chloride being suitable. The filler is not necessary, but normally it is present in an amount of at least 15% of the composition, more preferably at least 25%.

Other inert fillers are illustrated by urea and sodium chloride, though urea is more costly.

Various materials may optionally be present, and some of these are noted below.

Anionic surfactants, such as dodecyl hydrogen phosphate, methyl naphthalene sulfonate, sodium-2-acetamidohexadecane-1-sulfonate, and the like, may be included in amounts up to about 2%, but the essential surfactant in this invention must be nonionic.

Enzymes are a desirable adjunct when it is desired to maximize the capacity to solubilize proteins. In such instance, the chlorine bleach should be avoided, and an oxygen bleach used in its place. The low pH which characterizes the compositions proposed herein eases the burden of incorporating enzymes.

Various other auxiliary agents may be present up to a total of about 5%, preferably up to about 1%. These are illustrated by perfumes, flow control agents, colorants, moisture absorbents, carriers for the nonionic surfactant (if liquid), antifoam agents, and the like.

In this specification, examples, and claims, all proportions are by weight unless otherwise specified.

The invention is illustrated in the example which follows.

EXAMPLES OF MACHINE DISH WASH DETERGENT CONTAINING AMMONIUM COMPOUNDS

| | A | B | C | D | E | F |
|---|---|---|---|---|---|---|
| Ammonium Sulfate | 63.0 | 50.0 | 50.0 | — | 50.0 | — |
| Ammonium Borate | — | — | — | 40.0 | — | 40.0 |
| Sodium Sulfate | 32.0 | 36.0 | 45.0 | 55.0 | 25.0 | 45.0 |
| Potassium Chloride | — | — | — | — | 20.0 | — |
| Nonionic Surfactant (1) | 4.0 | 4.0 | 2.0 | 4.0 | 2.0 | 4.0 |

-continued

EXAMPLES OF MACHINE DISH WASH DETERGENT CONTAINING AMMONIUM COMPOUNDS

| | A | B | C | D | E | F |
|---|---|---|---|---|---|---|
| Other Surfactant | — | — | 2.0 (2) | — | 2.0 (3) | — |
| Chlorine Release Agent (4) | 1.0 | — | 1.0 | 1.0 | 1.0 | — |
| Sodium Perborate (12% active oxygen) | — | 10.0 | — | — | — | 10.0 |
| Protease Enzyme | — | — | — | — | — | 1.0 |
| | 100.0 | 100.0 | 100.0 | 100.0 | 100.0 | 100.0 |

(1) A 6 mol ethoxylate of straight chain n-dodecyl alcohol (BASF Wyandotte product Plurafac RA-43 may be used).
(2) Poly(oxypropylene) hydrophobe of molecular weight 1200 adducted with ethylene oxide to provide 40% poly(oxyethylene). BASF Wyandotte product Pluronic L-44 may be usd.
(3) A 3 mol ethoxylate of n-dodecyl alcohol.
(4) Potassium salt of dichlorocyanuric acid.

All of the above examples provided powdered detergent compositions which are effective machine dish washing detergents which can be used in hard water.

When the ammonium compound is ammonium carbonate or bicarbonate, then buffers are needed. Suitable detergents are constituted by 30.5 parts of ammonium carbonate or bicarbonate, 45 parts of sodium borax decahydrate, 15.4 parts of sodium bisulfate, 4.0 parts of the surfactant identified in note (1), and 5.1 parts of sodium perborate (12% active oxygen).

The invention is defined in the claims which follow.

We claim:

1. A powder detergent composition adapted for machine dish washing using hard water and which does not require the presence of phosphates consisting essentially of the following components by weight:
   1. as the essential surfactant, from 2–8% of low foaming nonionic surfactant useful for machine dish washing,
   2. from 0.5–5% of available chlorine or oxygen from a bleaching agent,
   3. from 8–70% of ammonium sulfate, ammonium borate, ammonium carbonate, ammonium bicarbonate, or a mixture thereof,
   4. from 0–50% of borax,
   5. from 0-to about 1% of a sequestrant having an affinity for iron, and
   6. any balance of said detergent consisting essentially of inert particulate filler which does not precipitate calcium or magnesium salts at use concentration, said composition providing a pH in the range of pH 7.0 - pH 8.5 when the composition is placed in 1% water solution.

2. A powder detergent composition as recited in claim 1 in which phosphates are absent from the composition.

3. A powder detergent composition as recited in claim 1 in which said sequestrant is ethylene diamine tetraacetic acid.

4. A powder detergent composition as recited in claim 1 in which said borax is present in an amount of at least 10%.

5. A powder detergent composition as recited in claim 1 in which said borax is present as a pentahydrate.

6. A powder detergent composition as recited in claim 1 in which said borax is present as a decahydrate.

7. A powder detergent composition as recited in claim 1 in which inert particulate filler is present in an amount of at least 15%.

8. A powder detergent composition as recited in claim 7 in which said inert particulate filler comprises sodium sulfate.

9. A powder detergent composition as recited in claim 1 in which said nonionic surfactant comprises an ethylene oxide adduct of hydrophobic organic compound, the adduct containing from about 3 to about 30 mols of adducted ethylene oxide per mol of said compound.

10. A powder detergent composition as recited in claim 1 in which said nonionic surfactant is an ethylene oxide adduct of a monohydric alcohol containing from 8–22 carbon atoms.

11. A powder detergent composition as recited in claim 10 in which said nonionic surfactant contains from 3–6 mols of ethylene oxide per mol of $C_8$ – $C_{18}$ primary straight chain alcohol.

12. A powder detergent composition as recited in claim 11 in which said nonionic surfactant further comprises a liquid in which ethylene oxide is adducted onto a poly(oxypropylene) hydrophobe having a molecular weight in the range of about 900 to about 4000, the adduct containing from about 5 to about 55% of poly(oxyethylene), the two types of nonionic surfactants being used in a weight ratio of from 1:5 to 5:1.

13. A powder detergent composition as recited in claim 12 in which said poly(oxypropylene) hydrophobe has a molecular weight of from 2100 -3600.

14. A powder detergent composition as recited in claim 1 in which said nonionic surfactant is used in an amount of from 3–6%.

15. A powder detergent composition as recited in claim 1 in which said composition further includes up to about 2% of anionic surfactant.

16. A powder detergent composition as recited in claim 1 in which said bleaching agent supplies active chlorine.

17. A powder detergent composition as recited in claim 1 in which enzymes are present in combination with an oxygen bleach.

18. A powder detergent composition as recited in claim 1 in which borax is absent, and said component (3) consists of 10–70% of ammonium sulfate.

19. A powder detergent composition as recited in claim 1 in which said component (3) is present in an amount of 25% to 50%.

20. A powder detergent composition as recited in claim 1 in which said inert particulate filler consists of sodium sulfate.

* * * * *